United States Patent [19]

Veater

[11] 4,043,048

[45] Aug. 23, 1977

[54] LABORATORY DRYING OVEN AND METHOD

[76] Inventor: Vallon C. Veater, 264 E. First North, Salina, Utah 84654

[21] Appl. No.: 653,231

[22] Filed: Jan. 28, 1976

[51] Int. Cl.[2] ..... F26B 3/30; F26B 19/00

[52] U.S. Cl. ..... 34/4; 34/202; 34/233; 34/234

[58] Field of Search ..... 34/1, 4, 201, 202, 232, 34/233, 234, ; 219/242

[56] References Cited

U.S. PATENT DOCUMENTS

| | | | |
|---|---|---|---|
| 1,470,653 | 10/1923 | Sullivan | 34/233 |
| 2,282,070 | 5/1942 | Mahannah | 34/4 |
| 2,618,076 | 11/1952 | Miller | 34/233 X |
| 2,676,417 | 4/1954 | Ekelund | 34/201 X |
| 2,864,932 | 12/1958 | Forrer | 34/4 |
| 3,093,460 | 6/1963 | Dietert | 34/1 |
| 3,643,346 | 2/1972 | Lester | 34/202 |
| 3,870,463 | 3/1975 | Werych | 34/1 |

*Primary Examiner*—John J. Camby
*Attorney, Agent, or Firm*—Mallinckrodt & Mallinckrodt

[57] ABSTRACT

One or more infrared heat lamps provide radiant heat at the top of a laboratory oven structure having a permanently open front and ventilation openings rearwardly thereof, so air will be drawn across a mass of discrete matter constituting a test sample being exposed to radiant heat within the oven. The interior of the oven structure is lined with a heat-resistant material, such as sheet asbestos, and a height-adjustable shelf arrangement within the oven provides for placing the test sample to be dried either closer or farther away from the infrared lamp or lamps. The oven is especially useful for drying samples of asphaltic road-building materials for highway construction or maintenance.

10 Claims, 5 Drawing Figures

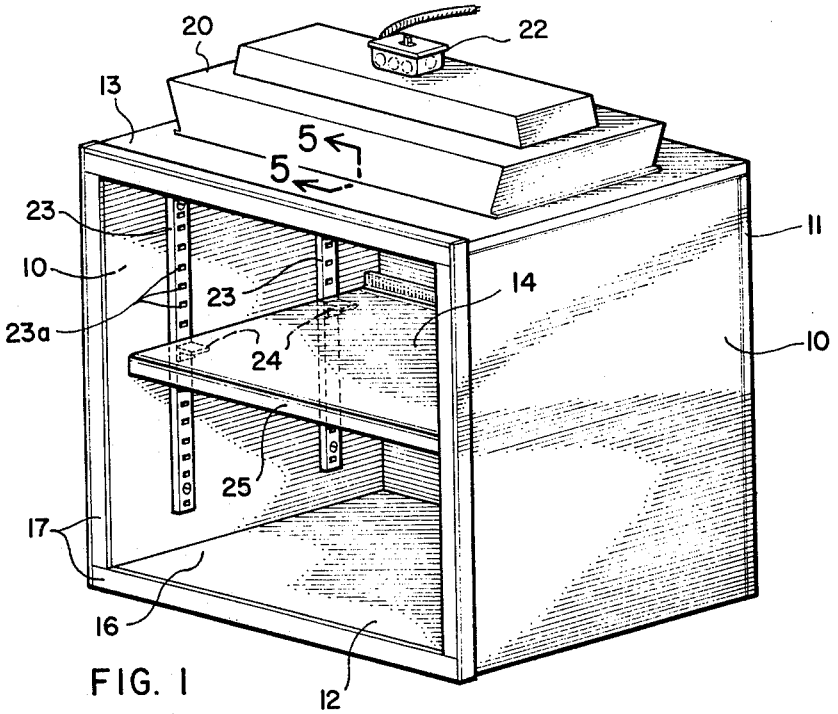
FIG. 1
FIG. 3
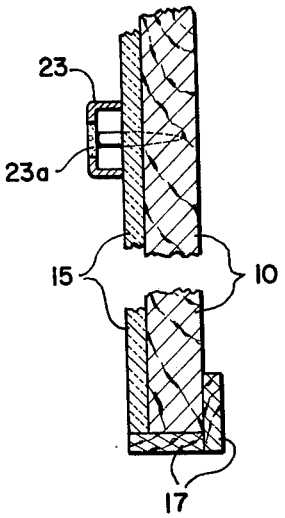
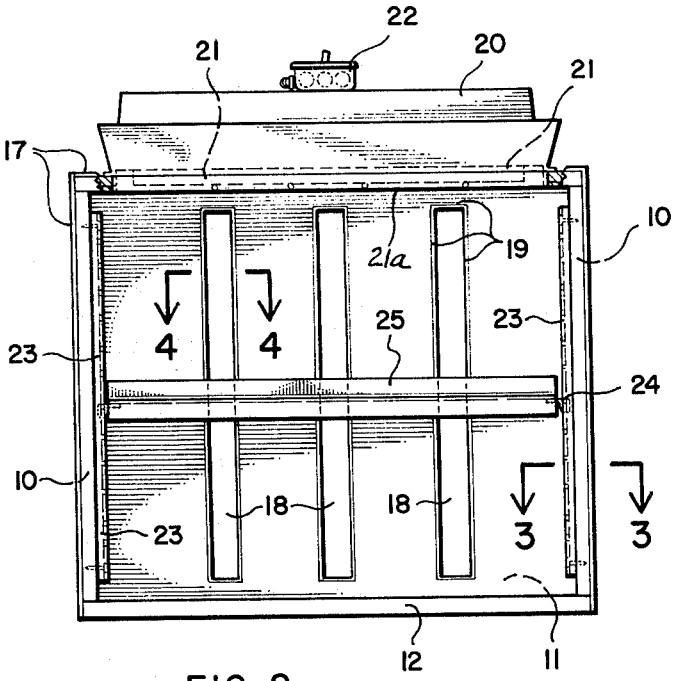
FIG. 2
FIG. 4
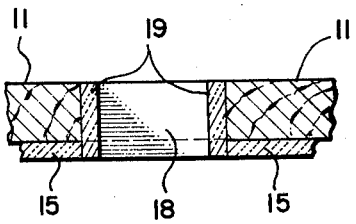
FIG. 5
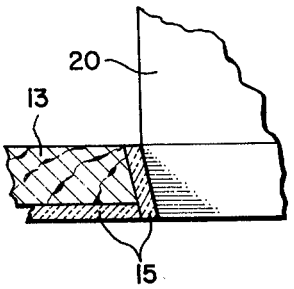

LABORATORY DRYING OVEN AND METHOD

BACKGROUND OF THE INVENTION

1. Field

The invention is in the field of laboratory drying ovens and methods of drying test samples of massed discrete matter.

2. State of the Art

Drying of test samples in laboratory work is normally carried out in closed ovens heated in various ways. Although such ovens are usually flame heated by the burning of fuel gas or are heated electrically by electrical resistance elements, microwave ovens are sometimes used, as are closed ovens having infrared lamps as heating elements.

SUMMARY OF THE INVENTION

In accordance with the invention, a test sample of massed discrete matter to be dried is placed below one or more infrared heat lamps in a confined space and at a distance determined by the desired degree of drying heat to be applied. The sample is heat irradiated while air is passed thereover from the atmosphere, either by natural or forced draft. The test sample is usually a mass of loosely associated, inorganic, particulate matter. The particle size may vary widely, as for example, from very fine soil particles to sand or gravel. Again, the test sample may be organic in character, with pieces of various sizes and shapes. In all of these instances, it is usually advantageous to stir the mass of discrete matter periodically during drying.

This procedure is advantageously carried out in a special laboratory oven constituting one aspect of the present invention. The oven comprises walls defining a box-like heating chamber having its front permanently open but otherwise closed except for ventilation openings rearwardly of the open front, preferably a series of elongate vertical openings in the back wall extending approximately from bottom to top of such wall of the heating chamber so as to provide for a sweep of atmospheric air substantially throughout the heating chamber by reason of either natural or forced draft. The oven is lined interiorly with heat-resistant material, such as sheet asbestos, and is provided as its top with one or more infrared heat lamps. Height-adjustable shelf means are provided within the heating chamber so as to be accessible from the open front for both receiving test samples to be dried and for height adjustment from time to time.

THE DRAWING

A laboratory drying oven, constituting the best mode presently contemplated for carrying out the invention in practice, is illustrated in the accompanying drawing in which:

FIG. 1 represents a pictorial view of the oven looking toward the open front and one side thereof;

FIG. 2, a front elevation, partly in vertical section to show placement of the infrared heat lamp;

FIG. 3, a fragmentary horizontal section taken on the line 3—3 of FIG. 2;

FIG. 4, a similar view taken on the line 4—4 of FIG. 2; and

FIG. 5, a fragmentary vertical section taken on the line 5—5 of FIG. 1.

DETAILED DESCRIPTION OF ILLUSTRATED EMBODIMENT

The embodiment illustrated is a laboratory oven in accordance with the invention which is especially useful for the drying of asphaltic road-building materials normally utilized in highway construction or maintenance. Such materials are mixtures of sand and/or gravel aggregate with an asphaltic substance and are commonly prepared in so-called "hot mix" plants. Samples of the prepared materials are customarily obtained by government authorities from contractors and are dried in laboratory ovens to determine bitumen content and to prepare the aggregate material for sieve analysis.

Heretofore, utilizing standard types of laboratory drying ovens, considerable time has been required for completing the drying of such samples. In accordance with this invention, drying time is significantly reduced; for example, so-called "extraction" procedures on test samples of asphaltic road materials that formerly required from two to sixteen hours can now be completed in from twenty to thirty minutes.

As illustrated, the laboratory oven comprises a box-like oven structure having mutually opposite, side walls 10, respectively, a back wall 11, bottom wall 12, and top wall 13, defining therebetween a heating chamber 14. These walls are advantageously made of ¾ inch plywood and are covered interiorly with ¼ inch of sheet asbestos 15 as a heat-resistant lining for the heating chamber. The front of the oven structure is permanently open, as at 16, with the perimeter of the opening being preferably faced with finish strips 17, which may be of wood.

To provide ventilation openings rearwardly of open front 16, back wall 11 has a series of elongate, relatively narrow, vertical openings 18 therein extending approximately from bottom to top of heating chamber 14. In the present instance, there are three such openings spaced 6 ½ inches apart in a back wall span of 2 feet 3 inches, with the series of three being equally spaced from the opposite side walls and each opening 18 being 1½ inches wide. The openings, like the oven interior, are lined with ¼ inch sheet asbestos, see the strips 19.

In the dimensions given above, the box-like oven structure itself (exclusive of the upwardly projecting heater) is 1 foot 11 inches high and 1 foot 9¼ inches deep from front to back. The ventilation openings 18 are each 19 inches long commencing 2 inches above the bottom and extending to 2 inches below the top of the heating chamber. None of the dimensions are critical, but are given as typical for information purposes only.

As so constructed, the oven structure and heating chamber therein are of rectangular box-like configuration, with the open front 16 being substantially equivalent in size with the back wall 11.

In the present instance, a single infrared lamp 20 is mounted centrally of top wall 13 within a receiving opening provided therefor. Its heat radiant face **20*a* is approximately flush with the interior face of the lining 15 of such wall. It is protectively housed in and of itself and rises above top 13 of the oven structure. As shown, lamp 20 is provided with two elongate bulbs 21. An electrical control switch 22** outside the oven structure enables an operator to turn heat on and off as desired.

The lamp 20 may be any one of a number of generally available, commercial makes, for example, a "90° Special Luminator" manufactured by Atkin Products, Geneva, Ohio. Depending upon the degree of heat desired and the rapidity of drying required, such "Luminator" lamp can be a 110–115 volt, 1000 watt type, or a 230 volt, 3200 watt type, the first taking two 500 watt quartzite bulbs and the second two 1600 watt quartzite bulbs.

A height-adjustable shelf arrangement is provided within heating chamber 14, so test samples can be placed closer to or farther away from lamp 20. As shown, transversely slotted metal strips 23 of a commercial type of adjustable height, shelf support which provides a series of clip-receiving slots 23*a* along the length, are fastened vertically in mutually spaced and opposing relationship to the respective side walls 10 over the interior linings thereof. Metal clips 24 are provided for selective positioning in these strips at desired heights, and a shelf 25 (of aluminum for example) is set freely on top of the clips. Both clips and shelf can be quickly removed and replaced at a different height by an operator working through open front 16. As an alternate arrangement, the clips could be permanently attached to the shelf.

In carrying out the method of the invention, one or more test samples that have been previously weighed are placed in respective stainless steel pans, and the pans are placed on shelf 25 by an operator working through open front 16, the shelf having been previously placed at an appropriate height within heating chamber 16. Switch 22 is then thrown to "on" position to energize infrared lamp 20. During heating, the test sample is stirred periodically by the operator working through open front 16.

If the test sample is an asphaltic road building material, the bitumen content is dissolved in customary manner by use of a solvent, such as methylene chloride, before the sample is placed in the oven, and the temperature of the mix is not allowed to exceed 190° F. (a thermometer is placed in the mix so it can be read through open front 16). The methylene chloride and dissolved bitumen volatilize and are carried out of the oven by air sweeping through open front 16, across the sample, and out ventilation openings 18. It is desirable to place the oven in front of a ventilation duct equipped with a fan, so there will be a forced draft through heating chamber 14 and exhaust of the noxious fumes to the exterior atmosphere.

Following weighing of the aggregate remaining in the sample pan, so the quantity of bitumen can be determined, shelf 25 is raised to place the test sample closer to infrared lamp 20 and the residual aggregate is heated to about 230° F., with periodic stirring, to volatilize moisture therefrom in preparation for the usual sieve analysis.

Whereas this invention is here illustrated and described with respect to a presently preferred embodiment thereof, various changes may be made without departing from the inventive concepts set forth in the claims that follow.

I claim:

1. A laboratory drying oven for drying test samples of massed discrete matter, comprising oven structure having side, back, bottom, and top walls defining a heating chamber with its front entirely and permanently open over the area extending between said side, bottom, and top walls and with ventilation openings disposed in said back wall at spaced intervals and comprehending a substantial portion of the area of said back wall rearwardly of the open front, so a draft of air will sweep through said chamber from and substantially throughout the area of the open front thereof, across the test samples, and out of said chamber through said ventilation openings rearwardly of said open front during operation of the oven; at least one infrared heating lamp arranged at the top of the chamber for directing radiant heat downwardly through the chamber; interior surfaces of said oven structure that are exposed to heat being heat resistant; and substantially horizontal, height-adjustable, material-supporting means of the nature of a shelf arranged within the chamber for receiving, through said open front, a test sample of material to be dried and for height adjustment by an operator working through said open front.

2. A laboratory drying oven in accordance with claim 1, wherein the at least one infrared heating lamp has its own protective housing and is positioned within an opening in the top wall of the oven structure, rising thereabove and having its heat radiant face substantially flush with the interior face of said top wall.

3. A laboratory drying oven in accordance with claim 1, wherein the ventilation openings are a series of relatively narrow, elongate openings formed through the back wall of the oven structure and extending approximately from bottom to top of the heating chamber.

4. A laboratory drying oven in accordance with claim 1, wherein the oven structure and heating chamber therein are of rectangular box-like configuration, the open front being substantially equivalent in size with the back wall.

5. A laboratory drying oven in accordance with claim 4, wherein the walls of the oven are of wood lined interiorly of the oven with heat insulating material.

6. A laboratory drying oven in accordance with claim 1, wherein the height-adjustable, material-supporting means within the heating chamber comprises transversely slotted strips secured in opposing, vertical relationship at interior wall faces of the heating chamber, and removable and replaceable shelf means for selective engagement with corresponding slots of said strips at desired heights.

7. A method of drying a mass of discrete matter constituting a test sample, comprising placing said mass on material-supporting means of the nature of a shelf below one or more infrared heat lamps in a drying oven having side, back, bottom, and top walls defining a heating chamber with its front entirely and permanently open over the area extending between said side, bottom, and top walls and with ventilation openings disposed in said back wall at spaced intervals and comprehending a substantial portion of the area of said back wall rearwardly of the open front; energizing said heat lamps so a draft of air will sweep through said chamber from and substantially throughout the area of the open front thereof across the test sample and out of the chamber through said ventilation openings rearwardly of said open front; and removing the test sample from the drying oven through said open front following the drying thereof.

8. A method in accordance with claim 7, wherein the test sample is stirred periodically during the infrared irradiation thereof.

9. A method in accordance with claim 7, wherein the temperature of the test sample is determined during the course of the heat treatment by means of a thermometer placed in the test sample mass.

10. A method in accordance with claim 7, wherein the test sample is an asphaltic road material in which the bitumen content has been dissolved by a solvent therefor; the oven is placed with its ventilation openings in front of an exhaust system; the solvent is first extracted from the sample by applying infrared heat radiation to the sample at a selected height placement thereof within the oven; and the moisture is thereafter extracted from the sample at a higher height placement thereof within the oven.

* * * * *